United States Patent [19]

Strauch et al.

[11] 4,338,608

[45] Jul. 6, 1982

[54] TRIPLE-BEAM OFFSET PARABOLOIDAL ANTENNA

[75] Inventors: Richard G. Strauch; David C. Hogg, both of Boulder, Colo.

[73] Assignee: The United States of America as represented by the Secretary of Commerce, Washington, D.C.

[21] Appl. No.: 192,261

[22] Filed: Sep. 30, 1980

[51] Int. Cl.[3] ..... H01Q 19/17; H01Q 3/24

[52] U.S. Cl. ..... 343/779; 343/840

[58] Field of Search ..... 343/840, 705, 779, 836, 343/703, 720

[56] References Cited

U.S. PATENT DOCUMENTS 3,317,912 5/1967 Kelleher ..... 343/836

3,406,401 10/1968 Tillotson ..... 343/705

3,936,835 2/1976 Phelan ..... 343/779

*Primary Examiner*—Eli Lieberman

*Attorney, Agent, or Firm*—Eugene J. Pawlikowski; Alvin J. Englert

[57] ABSTRACT

A triple-beam offset paraboloidal antenna minimizes the offset of each of three antenna feeds from the focal point of the paraboloid to thereby minimize beam aberrations, while at the same time maximizing the beam steering capability of the antenna. Three beams are produced, two being in mutually orthogonal planes. The axis of the third beam corresponds to the intersection of the orthogonal planes. The antenna in accordance with the present invention finds particular utility in the measurement of three dimensional wind profiles employing doppler radar techniques.

12 Claims, 1 Drawing Figure

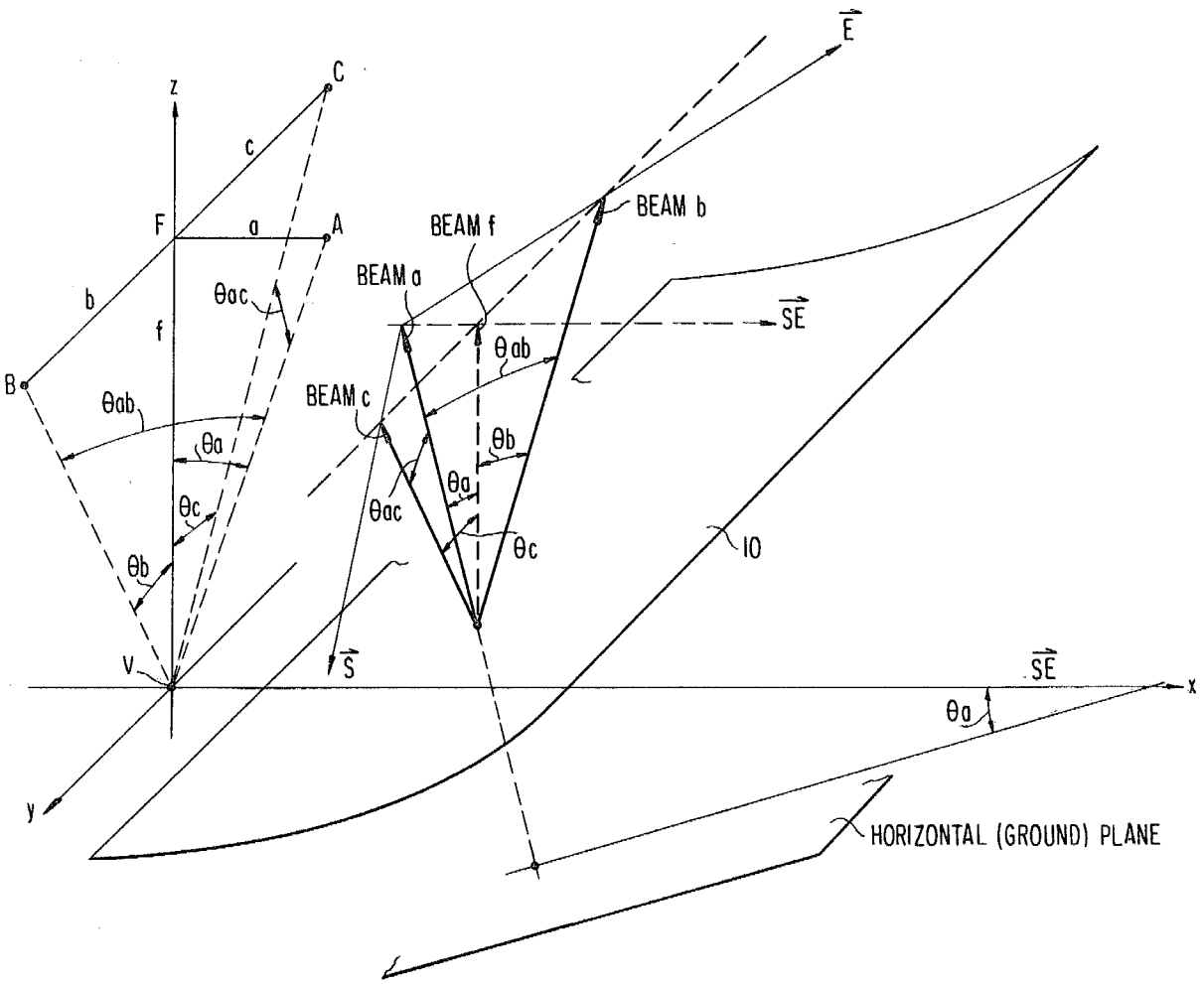
HORIZONTAL (GROUND) PLANE
x
y
z
SE
E
S
V
10
BEAM a
BEAM b
BEAM c
BEAM f
A
B
C
F
a
b
c
f
θa
θb
θc
θab
θac

TRIPLE-BEAM OFFSET PARABOLOIDAL ANTENNA

BACKGROUND OF THE INVENTION

The present invention is related to the field of multiple beam antenna systems and, more specifically, to a triple beam antenna system for efficiently producing three beam pointing directions without moving parts.

Offset paraboloidal antennas are commonly used in applications where good side lobe performance and good impedance matching are desired, since the offset arrangement of antenna feeds and reflector avoids the generation of side lobes due to blockage caused by an inline secondary reflector or prime focus feed.

It is well known that offset paraboloidal antennas may be provided with feeds offset from the focal point of the paraboloid when it is desired to direct the radiation field in a direction other than that produced by a feed located at the focal point. U.S. Pat. No. 3,696,435 to Zucker is one such system.

Beam steering, a changing of the direction of the radiation pattern, can be accomplished by having more than one feed point. The feed points can be switched electronically or mechanically so that the radiation can be pointed in a number of predetermined directions without physically moving the antenna. However, the amount of beam steering that can be accomplished in this manner is usually limited to less than five beamwidths due to the effect of increased coma and other aberrations which result from not operating at the focal point. More important, the smaller the displacement of the feed from the focal point, the better the directive quality of the radiation pattern. Therefore, the antenna feeds should be displaced from the focal point by as small a distance as possible.

SUMMARY OF THE INVENTION

It is an object of the present invention to provide an antenna system having a paraboloidal reflector, and three antenna feeds offset from the focal point of the paraboloid for producing three beams, two being in mutually orthogonal planes, and the third corresponding to the intersection of the orthogonal planes. The technique in accordance with the present invention results in a first beam directed toward zenith, a second beam 15 degrees off zenith toward the east, and a third beam 15 degrees off zenith toward the south. The three beams are generated from three antenna feeds which are minimally offset from the focal point of the parabola to provide beams 10.5 degrees offset from the axis of the paraboloid. By tilting the antenna reflector and feeds by approximately 10.5 degrees with respect to horizontal, a zenith beam and two orthogonal beams 15 degrees from zenith are produced.

BRIEF DESCRIPTION OF THE DRAWING

The single drawing FIGURE illustrates the geometry of the antenna feeds and reflector in accordance with the present invention.

DETAILED DESCRIPTION OF THE PREFERRED EMBODIMENTS

One application of a multiple beam antenna having no mechanically moving parts is in the three dimensional measurement of winds by Doppler radar. The three dimensional wind measurement entails a measurement of vertical, east/west, and north/south winds. Since three orthogonal components of the wind need to be observed, three radar beams having mutually orthogonal components are required.

The beams employed in the three dimensional measurement of a wind profile do not have to be exclusively orthogonal with respect to each other. Rather, it is necessary only that the three beams respond to orthogonal vector components of the wind. In order to measure the winds at various heights, the beams pointing east/west and north/south may be tilted from the vertical, or zenith, by a particular angle. An elevation angle of 75 degrees from the horizontal, corresponding to a 15 degree tilt from the vertical, has been found to be acceptable. The present invention thus provides a technique for producing the minimum 15 degree offset between beams while at the same time minimizing the offset of the antenna feeds from the focal point.

A three dimensional view of the antenna is illustrated in the sole FIGURE. The offset paraboloidal reflecting surface 10 has a focus at point F and a vertex at point V. The generating surface for reflector 10 is a paraboloid having the formula $$z=(x^2+y^2)/4f,$$

where f is the focal length equal to the distance between points F and V.

A hypothetical antenna feed located at point F and directed toward reflector 10 would produce a hypothetical Beam f as shown. By linearly offsetting the location of the antenna feed in a direction parallel to the X axis to point A, Beam a, separated from Beam f along the X axis as shown, would be produced. The angle $\theta_a$ between the lines running from the vertex V to points F and A is also produced between Beams a and f.

Similarly, a linear displacement of the antenna feed from point F along a line parallel to the Y axis to point B will produce Beam b which is similarly separated from beam f in the Y direction. The angle $\theta_b$ between vectors VB and VF is equal to the angle $\theta_b$ between Beams b and f.

Finally, an antenna feed located at point C, linearly displaced from the focal point F along the Y axis, will produce a Beam c similarly separated from Beam f by angle $\theta_c$ along the y axis.

More specifically, the offset paraboloidal reflecting surface 10 has its focus F at Cartesian coordinates (0, 0, f) such that a hypothetical feed located at point F would produce Beam f having an axis normal to the XY plane. An antenna feed located at point A with coordinates (a, 0, f) produces Beam a having an axis lying in the XZ plane at an angle $\theta_a$ from Beam f. A feed located at point B having coordinates (0, −b, f) produces Beam b having a radiation pattern axis lying in the YZ plane at an angle $\theta_b$ from Beam f. Finally, an antenna feed located at point C having coordinates (0, b, f) produces Beam c having a radiation pattern axis lying in a plane parallel to the YZ plane at an angle $\theta_b$ from Beam f.

Assuming that the distances of the feeds A, B and C from focal point F are all equal, a=b=c, then $\theta_a=\theta_b=\theta_c$. Since $\theta_a=\theta_b=\theta_c$, the plane containing the axes of Beams a and b is orthogonal to the plane containing the axes of Beams a and c.

Although the angle between hypothetical Beam f and each of Beams a, b and c is equal to $\theta_a$, for example, the angles $\theta_{ab}$ and $\theta_{ac}$ between Beams a and b, and between Beams a and c, respectively, are each equal to $\sqrt{2}\ \theta_a$.

Therefore, if $\theta_a=\theta_b=\theta_c\cong 10.5$ degrees, $\theta_{ab}=\theta_{ac}\cong 15$ degrees.

It can now be seen that by rotating the reflector 10 and feeds A, B and C about the Y axis relative to a horizontal or ground plane, such that the X axis subtends an angle of $\theta_a$ with respect to the horizontal or ground plane, Beam a will be pointed vertically to provide a zenith beam. Further, if the X axis is directed in a southeasterly direction, Beam b will be offset from Beam a by $\theta_{ab}=15$ degrees due east, while Beam c will be separated from Beam a by $\theta_{ac}=15$ degrees due south to thereby provide a zenith beam and two beams in orthogonal vertical planes.

The advantages of the present invention reside in the fact that, while the feed offset distance is minimized, the beam steering capability is maximized. Specifically, the feeds A, B and C need only be offset from the focal point F by $\theta_a=\theta_b=\theta_c=10.5$ degrees, while at the same time producing Beams a, b and c which are mutually offset by $\theta_{ab}=\theta_{ac}=15$ degrees.

The specific design of the antenna system in accordance with the present invention, when used to provide a ground based measurement of three dimensional atmospheric wind profiles, is as follows. For operation at approximately 915 MHz for profiling winds in the troposphere, the reflector may be approximately 34×34 ft., constituting more than 1,000 sq. ft. of area. The focal length f is approximately 26.2 ft., thereby providing an equation for the paraboloidal reflector surface 10 as $$z=(x^2+y^2)/104.8 \text{ ft.}$$

The actual reflector structure begins at a line defined by $X\cong 4$ ft. and terminates at $X\cong 36$ ft. The wavelength $\lambda$ of the radiation at 915 MHz is approximately 32.8 cm. Since the overall shape of the paraboloidal surface must be held to $\pm\lambda/50$, the tolerance of the reflector contour is approximately one-quarter inch.

The antenna feed horns at points A, B and C may be conical, 60 inches long and have a maximum diameter of 55 inches. The apertures of the horns may be located approximately 70 inches from the focal point F. However, it has been found that the exact placement of the horns may vary by almost 5 inches when phase effects in the particular feed horn design are taken into account.

Thus, the present invention provides a technique for producing three beams for measuring the Doppler velocity of mutually orthogonal vector wind components. Although the antenna feeds are offset to produce beams offset from a hypothetical focal point beam by angle $\theta$, the beam steering capability is maximized to provide beams offset by an angle $\sqrt{2}\theta$. Therefore, by minimizing the amount of antenna horn offset, coma and other radiation pattern aberrations are minimized to produce a high quality radiation pattern for each of the beams.

Various changes, additions and omissions of elements may be made within the scope and spirit of this invention. It is to be understood that the invention is not limited to specific details, examples and preferred embodiments shown and described herein.

We claim:

1. A beam steered antenna system for use in a wind profile measuring system comprising:

a reflecting surface describing a portion of a paraboloidal section having a vertex V and a focal point F defining an axis V-F;

at least first and second antenna feeds offset from said axis V-F for respectively producing at least first and second beam patterns;

said reflecting surface and said at least first and second antenna feeds being oriented such that said first beam pattern has an axis lying along a first predetermined reference direction, wherein the angle $\theta_1$ between the axes of said first beam pattern and said second beam pattern is larger than each of (i) the angle $\theta_2$ between said axis V-F and a line from said vertex V to said first antenna feed, and (ii) the angle $\theta_3$ between said axis V-F and a line from said vertex V to said second antenna feed, and wherein said reference direction is substantially perpendicular to a reference horizontal ground plane.

2. The antenna system of claim 1 wherein lines from said at least first and second antenna feeds to said axis V-F form a substantially right angle, and said angles $\theta_2$ and $\theta_3$ are substantially equal, whereby said angle $\theta_1$ is greater than each of $\theta_2$ and $\theta_3$ by a factor of substantially $\sqrt{2}$.

3. The antenna system of claim 2 wherein said at least first and second antenna feeds lie in a plane substantially perpendicular to said axis V-F and are substantially equidistant from said axis V-F.

4. The antenna system of claim 1 further providing a third antenna feed offset from said first axis for providing a third beam pattern, wherein the angle $\theta_4$ between the axes of said first beam pattern and said third beam pattern is larger than the angle $\theta_5$ between said axis V-F and a line from said vertex V to said third antenna feed.

5. The antenna system of claim 4 wherein a line from said third antenna feed to said axis V-F is substantially at right angles with a line from said first antenna feed to said axis V-F, said third antenna feed is located on a side of said first antenna feed opposite said second antenna feed, and said angles $\theta_2$, $\theta_3$ and $\theta_5$ are substantially equal, whereby said angles $\theta_1$ and $\theta_4$ are substantially equal and greater than each of $\theta_2$, $\theta_3$ and $\theta_5$ by a factor of $\sqrt{2}$.

6. The antenna system of claim 5 wherein said third antenna feed lies in a plane substantially perpendicular to said axis V-F and is substantially the same distance from said axis V-F as said first and second antenna feeds.

7. The antenna system of any one of claims 1–6 wherein said reference horizontal ground plane is the surface of the earth.

8. The antenna system of any one of claims 1–6 wherein said reference horizontal ground plane is the surface of the earth, and wherein a second predetermined reference direction, defined by a line from said axis V-F through said first antenna feed, is directed along one of NW/SE and NE/SW directions, whereby said second beam pattern is tilted away from the vertical along one of east/west and north/south directions, respectively.

9. The antenna system of claim 4, 5 or 6 wherein said reference horizontal ground plane is the surface of the earth, and wherein a second predetermined reference direction, defined by a line from said axis V-F through said first antenna feed, is directed along one of NW/SE, or NE/SW directions, whereby said second beam pattern is tilted away from the vertical along one of east/west or north/south directions, respectively, and whereby said third beam pattern is tilted away from the vertical along one of north/south or east/west directions, respectively.

10. The antenna system of any one of claims 1–6 wherein said reflecting surface and antenna feeds are oriented such that a plane perpendicular to said axis V-F subtends an angle with respect to said horizontal ground plane of approximately $\theta_2$.

11. The antenna system of any one of claims 1–6 wherein said paraboloidal section face is defined by $$z=(x^2+y^2)/4f,$$

where z is the direction along said axis V-F, x is the direction of a line from and perpendicular to said axis V-F through said first antenna feed, y is the direction orthogonal to said z and x directions, and f is the distance from said vertex V to said focal point F.

12. The antenna system of any one of claims 1–6 wherein said reference horizontal ground plane is the surface of the earth, wherein said paraboloid section is defined by $$z=(x^2+y^2)/4f,$$

where z is the direction along said axis V-F, x is the direction of a line from and perpendicular to said axis V-F through said first antenna feed, y is the direction orthogonal to said z and x directions, and f is the distance from said vertex to said focal point F, and wherein said reflector does not pass through the y-z plane.

* * * * *